US006334610B1

(12) United States Patent
Minamishin et al.

(10) Patent No.: US 6,334,610 B1
(45) Date of Patent: Jan. 1, 2002

(54) LEAF TRANSFER MECHANISM UNIT

(75) Inventors: Hayato Minamishin; Hayami Abe; Masato Koike, all of Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/536,996

(22) Filed: Mar. 29, 2000

(30) Foreign Application Priority Data

Sep. 30, 1999 (JP) ..... 11-277965

(51) Int. Cl.[7] ..... B65H 5/22

(52) U.S. Cl. ..... 271/3.04; 271/126; 271/157; 271/158

(58) Field of Search ..... 271/3.04, 3.01, 271/126, 147, 157, 158, 159

(56) References Cited

U.S. PATENT DOCUMENTS 5,199,697 A * 4/1993 Yamada et al. ..... 271/126 X
5,398,931 A * 3/1995 Tohgoh ..... 271/157 X
6,015,147 A 1/2000 Kimura et al. ..... 271/163

FOREIGN PATENT DOCUMENTS

JP 2-163259 6/1990
JP 95-02142 11/1995
JP 9-147193 6/1997

* cited by examiner

*Primary Examiner*—David H. Bollinger
(74) *Attorney, Agent, or Firm*—Armstrong, Westerman, Hattori, McLeland & Naughton, LLP

(57) ABSTRACT

A leaf transfer mechanism unit, to be incorporated in general in an automatic teller machine, defines a leaf reception room between a pickup roller and a partition member. Behind the partition member, a leaf delivery room is defined between the partition member and a retrieval urging member. When the retrieval urging member is allowed to move forward within the limit of a front limit position, bills received in the leaf delivery room can be urged against the pickup roller. During this operation, the partition member is kept at a turnout position beyond the front limit position of the retrieval urging member. The pickup roller is exposed behind the partition member. Since the turnout position can be defined at the extension of the path of movement for the retrieval urging member, it is possible to avoid the partition member at the turnout position from largely and remarkably protruding out of the path of movement. The leaf transfer mechanism unit is thus allowed to operate within a smaller space as compared with a prior art leaf transfer mechanism unit.

10 Claims, 8 Drawing Sheets

LEAF TRANSFER MECHANISM UNIT

BACKGROUND OF THE INVENTION

1. Field of the Invention

The present invention relates to a leaf management apparatus such as an automatic teller machine (ATM) located in a bank, a convenience store, and the like, for example.

2. Description of the Prior Art

A leaf transfer mechanism unit incorporated in an ATM is well known as is disclosed in Japanese Patent Laid-open No. 9-147193, for example. The leaf transfer mechanism unit may comprise a leaf reception room defined between a pickup roller and a front or reception urging member. When a customer intends to deposit cash, the leaf reception room is designed to receive bills. The reception urging member is driven to move forward so as to urge the received bills against the pickup roller. Rotation of the pickup roller serves to sequentially transfer the bills, one by one, to a discrimination section.

Behind the reception urging member, a leaf delivery room is defined between a partition member and a rear or retrieval urging member. Bills determined unacceptable at the discrimination section, such as false bills and other types of leaves, are temporarily stored in the leaf delivery room. When all of the bills have been taken out of the leaf reception room, the retrieval urging member is driven to move forward toward the pickup roller. Such advancement of the retrieval urging member causes the leaf delivery room to lead to a leaf delivery opening of the ATM. The customer is allowed to pick up the bills or other types of leaves, which have been determined unacceptable at the discrimination section, out of the leaf delivery opening.

If the customer has left the unacceptable bills and other types of leaves in the leaf delivery room, the left bills and leaves should be retrieved into a retrieval container. The retrieval urging member is driven to move forward so as to urge the left bills and leaves against the pickup roller. When the pickup roller is driven to rotate, the left bills and leaves are sequentially transferred, one by one, to the retrieval container.

During such operation, the aforementioned reception urging member and the partition member in front of the retrieval urging member should be removed from the path of movement for the retrieval urging member advancing toward the pickup roller.

Removal of the partition member may be achieved, as is disclosed in the aforementioned Japanese Patent Laid-open No. 9-147193, by moving the upright partition member in the direction perpendicularly intersecting the path of movement for the retrieval urging member. However, such movement of the partition member inevitably suffers from occupation of a larger space in the ATM. Moreover, the disclosed leaf transfer mechanism unit is designed to drive the partition member and the reception urging member by separate drive sources, so that a drive mechanism inevitably gets complicated.

SUMMARY OF THE INVENTION

It is accordingly an object of the present invention to provide a leaf transfer mechanism unit capable of operating or acting within a smaller space.

According to a first aspect of the present invention, there is provided a leaf transfer mechanism unit comprising: a pickup roller; a retrieval urging member designed to move forward toward the pickup roller along a predetermined path leading to a front limit position allowing the retrieval urging member to collide against the pickup roller; and a partition member designed to move forward in front of the retrieval urging member along the predetermined path beyond the front limit position for the retrieval urging member so as to reach a turnout position.

When the retrieval urging member is allowed to move forward, bills received between the pickup roller and the retrieval urging member can be urged against the pickup roller. The rotating pickup roller serves to sequentially transfer the bills, one by one, urged against the pickup roller. During this operation of the pickup roller, the partition member is allowed to move forward to the turnout position beyond the front limit position for the retrieval urging member, so that the retrieval urging member is reliably prevented from interfering or colliding with the partition member during the advancement of the retrieval urging member.

In general, the partition member and the retrieval urging member are kept in an attitude upright to the predetermined path of movement. If the turnout position of the partition member can be defined at the extension of the predetermined path of movement, it is possible to avoid the partition member at the turnout position from largely and remarkably protruding out of the predetermined path of movement. The leaf transfer mechanism unit is thus allowed to operate within a smaller space as compared with a prior art leaf transfer mechanism unit.

According to a second aspect of the present invention, there is provided a leaf transfer mechanism unit comprising: a pickup roller; a partition member designed to move toward the pickup roller; a leaf reception room defined between the pickup roller and the partition member; a retrieval urging member designed to move forward toward the pickup roller within the limit of a front limit position allowing the retrieval urging member to collide against the pickup roller; and a leaf delivery room defined behind the partition member between the partition member and the retrieval urging member, wherein the partition member is designed to reach a turnout position where the pickup roller is exposed in the leaf delivery room behind the partition member.

With the above arrangement, bills can be received in the leaf reception room defined between the pickup roller and the partition member while bills can also be received in the leaf delivery room defined between the partition member and the retrieval urging member. When all bills are taken out of the leaf reception room, the bills in the leaf delivery room are then subjected to a transferring operation. During the transferring operation, the bills can reliably be urged against the pickup roller exposed behind the partition member which is kept at the turnout position. The rotating pickup roller serves to sequentially transfer the bills, one by one, out of the leaf delivery room.

As described above, the partition member is usually kept in an attitude upright to its path of movement. If the turnout position of the partition member can be defined at the extension of the path of movement, it is possible to avoid the partition member at the turnout position from largely and remarkably protruding out of the path of movement. The leaf transfer mechanism unit is thus allowed to operate within a smaller space as compared with a prior art leaf transfer mechanism unit.

The leaf transfer mechanism unit may further comprise a reception urging member interlocked with or incorporated in the partition member and designed to move forward toward the pickup roller within the limit of a collision position allowing the reception urging member to collide against the pickup roller. This arrangement allows the reception urging member to urge bills, received between the partition member and the pickup roller, against the pickup roller when the reception urging member is allowed to move forward. The rotating pickup roller serves to sequentially transfer the bills, one by one, urged against the pickup roller.

The leaf transfer mechanism unit may further comprise: a guide passage formed in the partition member for guiding movement of the reception urging member; and a driving piece connected to the reception urging member and designed to move along a circular orbit described around a rotation axis in parallel with a rotational axis of the pickup roller. With this arrangement, the movement of the drive piece along the orbit causes not only movement of the reception urging member but also movement of the partition member interlocked with the reception urging member. A drive source may be employed common to the reception urging member and the partition member. A drive mechanism can be simplified as compared with a prior art leaf transfer mechanism unit.

Alternatively, the aforementioned leaf transfer mechanism unit may further comprise: a reception urging member disposed between the pickup roller and the retrieval urging member at a rearmost position remotest from the pickup roller; and a guide passage formed in the partition member for guiding movement of the reception urging member. In this case, the reception urging member is designed to selectively trace a first and a second advancement path. The first advancement path extends toward the pickup roller from the rearmost position so as to reach a collision position allowing the reception urging member to collide against the pickup roller, while the second advancement path extends from the rearmost position so as to make a roundabout of the pickup roller. When the reception urging member traces the first advancement path, the reception urging member is allowed to urge bills, received between the pickup roller and the partition member, against the pickup roller. On the other hand, when the reception urging member traces the second advancement path, the partition member is allowed to reach the turnout position without inducing collision between the reception urging member and the pickup roller during the advancement of the partition member.

The above arrangement may employ a driving piece connected, directly or indirectly, to the reception urging member so as to move along a circular orbit described around a rotation axis in parallel with a rotational axis of the pickup roller. The driving piece serves to drive the reception urging member along the first and second advancement paths with a relatively simpler structure.

According to a third aspect of the present invention, there is provided a leaf transfer mechanism unit comprising: a pickup roller; a rear urging member designed to move forward toward the pickup roller within the limit of a front limit position allowing the rear urging member to collide against the pickup roller; and a front urging member disposed between the pickup roller and the rear urging member at a rearmost position remotest from the pickup roller, wherein the front urging member selectively traces a first and a second advancement path, the first advancement path extending toward the pickup roller from the rearmost position so as to reach a collision position allowing the front urging member to collide against the pickup roller, the second advancement path extending from the rearmost position so as to make a roundabout of the pickup roller.

With the above arrangement, bills can be received between the pickup roller and the front urging member, at the same time, bills can be received between the front and rear urging members. When the front urging member traces the first advancement path, the front urging member is allowed to urge the bills, received between the pickup roller and the front urging member. The rotating pickup roller serves to sequentially transfer the received bills, one by one. Moreover, when rear urging member moves forward following the advancement of the front urging member along the second advancement path, the rear urging member is allowed to reach the front limit position without inducing the collision between the front urging member and the pickup roller. The rear urging member is allowed to reliably urge the bills, received between the front and rear urging members, against the pickup roller. The received bills can thus sequentially be transferred one by one.

In general, the front and rear urging members are kept in an attitude upright to the path of movement for the rear urging member. If the front urging member is allowed to trace the second advancement path keeping the attitude, it is possible to avoid the front urging member from largely and remarkably protruding out of the path of movement of the rear urging member. The leaf transfer mechanism unit is thus allowed to operate within a smaller space as compared with a prior art leaf transfer mechanism unit.

The above arrangement may employ a driving piece connected, directly or indirectly, to the front urging member so as to move along a circular orbit described around a rotation axis in parallel with a rotational axis of the pickup roller. The driving piece serves to drive the front urging member along the first and second advancement paths with a relatively simpler structure.

The aforementioned leaf transfer mechanism unit may be incorporated in a leaf management apparatus such as an automatic teller machine (ATM), for example. The leaf may include any of a paper sheet such as a money bill and a valuable ticket, a magnetic card, a plastic card such as a credit card, and the like.

BRIEF DESCRIPTION OF THE DRAWINGS

The above and other objects, features and advantages of the present invention will become apparent from the following description of the preferred embodiment in conjunction with the accompanying drawings, wherein.

DESCRIPTION OF THE PREFERRED EMBODIMENT

Figure 1:
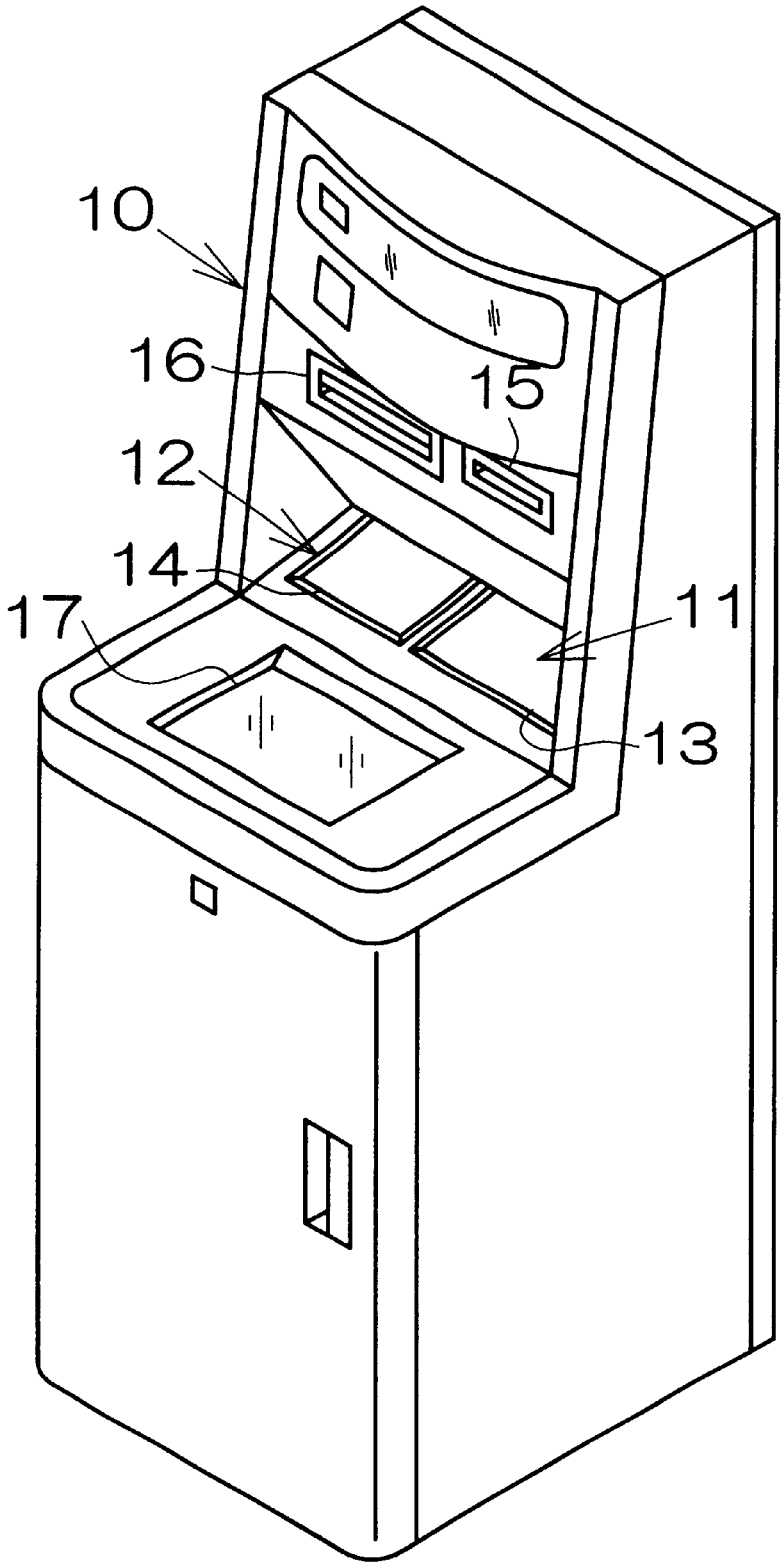
FIG. 1 is a perspective view illustrating an automatic teller machine (ATM)

FIG. 1 illustrates an automatic teller machine (ATM) 10 as a leaf or sheet management apparatus. The operation of the ATM 10 allows a customer to deposit and/or draw cash in and/or from an own account, to pay cash into another account, or the like. When the customer intends to deposit or pay cash, bills can be received in the ATM 10 through a leaf input opening 11 while coins can be received in the ATM 10 through a coin input opening 12. When the customer intends to draw cash, the customer can pick up bills and coins through the leaf input opening 11 and the coin input opening 12, respectively. The bill input opening 11 and the coin input opening 12 can be closed with covers 13, 14, respectively.

In general, a cash card is employed to operate the ATM 10. The cash card can be inserted into the ATM through a card insertion opening 15. In addition, the ATM 10 is designed to make an entry of each item in a bankbook. The bankbook can be inserted into the ATM 10 through a book insertion opening 16.

The ATM 10 includes a so-called touch panel 17. Key buttons for options as well as ten keys and character keys can be displayed on the screen of the touch panel 17. When a customer touches any of the key buttons, the ten keys and the character keys, the ATM 10 is designed to detect or recognize a signal corresponding to the touched key button or key. The operation of these key buttons and keys can be employed to input the sum of cash to be dispensed, a code number of a cash card, or the like, into the ATM 10.

Figure 2:
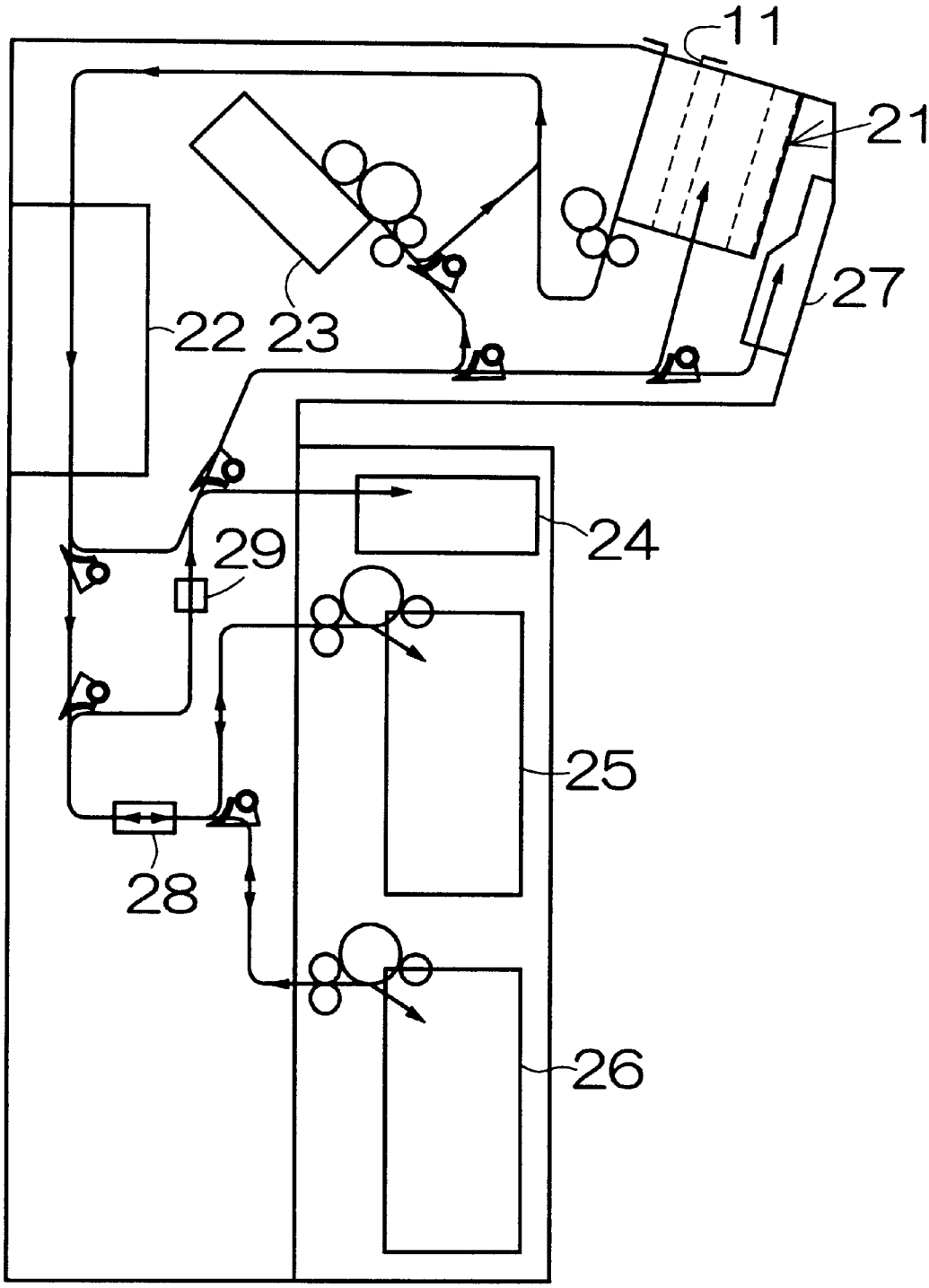
FIG. 2 schematically illustrates paths for transfer of bills within the ATM.

As shown in FIG. 2, a leaf transfer mechanism unit 21 is connected to the leaf input opening 11. When a plurality of or a stack of bills are inserted into the leaf input opening 11, the leaf transfer mechanism unit 21 is designed to sequentially transfer the input bills one by one. The bills are then transferred to a discrimination section 22. The discrimination section 22 is designed to distinguish genuine bills from false bills and other types of leaves and to calculate the total amount of money for the genuine bills.

The genuine bills are transferred to a temporary storage room 23. The remaining leaves, which have been determined unacceptable, are returned to the leaf transfer mechanism unit 21. The remaining leaves may include false bills and other types of leaves such as shopping receipts. A customer is allowed to pick up the leaves, returned to the leaf transfer mechanism unit 21, through the leaf input opening 11. The genuine bills temporarily stored in the temporary storage room 23 can be returned to the leaf transfer mechanism unit 21 through the discrimination section 22 in response to cancellation of the transaction. The customer is allowed to pick up the returned genuine bills out of the leaf transfer mechanism unit 21.

On the other hand, when continuation of the transaction has been confirmed, the genuine bills stored in the temporary storage room 23 is transferred to the discrimination section 22 a second time. This time, the discrimination section 22 serves to distinguish reusable ¥10,000 bills and ¥1,000 bills from the remaining genuine bills such as heavily damaged ¥10,000 and ¥1,000 bills, not suitable to reuse, and the other kinds of genuine bills, including ¥5,000 bills, for example. The remaining genuine bills are retrieved into a storage container 24. The reusable genuine ¥10,000 bills are transferred to a ¥10,000 bill container 25, while the reusable genuine ¥1,000 bills are transferred to a ¥1,000 bill container 26. The customer sometimes carelessly leaves the bills which has been not received in the ATM 10. The bills left in the leaf transfer mechanism unit 21 is transferred to a retrieval container 27 through the discrimination section 22.

When a customer intends to take cash out of the ATM 10, ¥10,000 bills and/or ¥1,000 bills corresponding to the requested amount of money are picked up from the ¥10,000 bill container 25 and/or the ¥1,000 bill container 26. The width and thickness of the bills are then measured and examined at a width sensor 28 and a thickness sensor 29, respectively. The approved bills are thereafter transferred to the leaf transfer mechanism unit 21. The customer is expected to receive a set of ¥1,000 bills and/or ¥1,000 bills corresponding to the requested amount of money out of the leaf input opening 11. The customer sometimes carelessly leaves the bills dispensed in the leaf transfer mechanism unit 21. The bills left in the leaf transfer mechanism unit 21 is transferred to the retrieval container 27 through the discrimination section 22.

Figure 3:
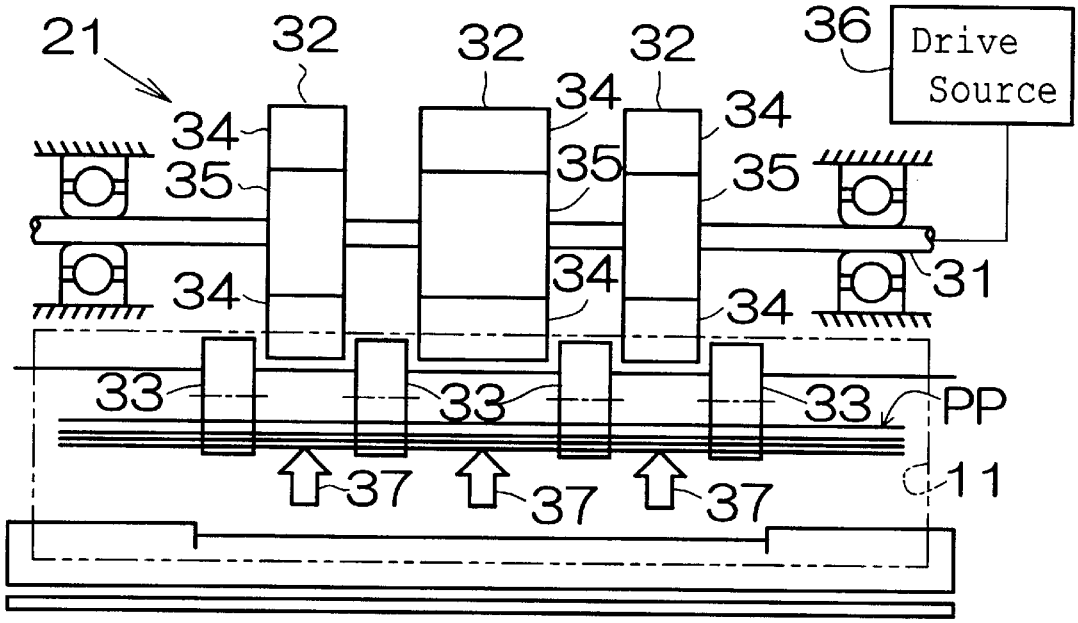
FIG. 3 is an enlarged plan view, observed through a leaf input opening, schematically illustrating a leaf transfer mechanism unit.

Next, the structure of the leaf transfer mechanism unit 21 will be described in detail. As shown in FIG. 3, the leaf transfer mechanism unit 21 comprises, for example, three rotative pickup rollers 32 supported on a rotation axis 31 for rotation, and four separators 33 arranged alternately with the pickup rollers 32 in the longitudinal direction of the rotation axis 31. As is conventionally known, the pickup roller 32 includes a slippery surface 34 defined on the outer cylindrical periphery for allowing the slippage between the pickup roller 32 and a leaf during rotation of the pickup roller 32, and a friction surface 35 likewise defined on the outer cylindrical periphery for generating a larger friction between the pickup roller 32 and a leaf during rotation of the pickup roller 32. A drive source 36 is designed to control the rotation or action of the pickup rollers 32. The drive source 36 may comprise a servo motor responsive to pulse signals, for example. The separator 33 comprises at least a friction surface defined on the outer surface. A rubber roller, prevented from rotation, may be employed as the separator 33, for example.

As is apparent from FIG. 3, a stack of bills PP are urged against the pickup rollers 32 in the radial direction 37 of the pickup rollers 32. When the rotating pickup rollers 32 contact the first or top bill PP at the friction surface 35, the rotation of the pickup rollers 32 is transformed into a movement of the first bill PP between the pickup rollers 32 and the separators 33. The first bill PP is then transferred to subsequent rollers, not shown. The separators 33 are designed to exert a friction on the remaining bills PP, namely, the second and subsequent bills PP. The remaining bills PP cannot pass by the separators 33. When the slippery surface 34 comes to contact the top bill PP of the stack, the rotation of the pickup rollers 32 is terminated. The pickup rollers 32 are designed to repeat such an action or behavior in the aforementioned manner until all of the bills PP in the leaf transfer mechanism unit 21 are taken out.

Figure 4:
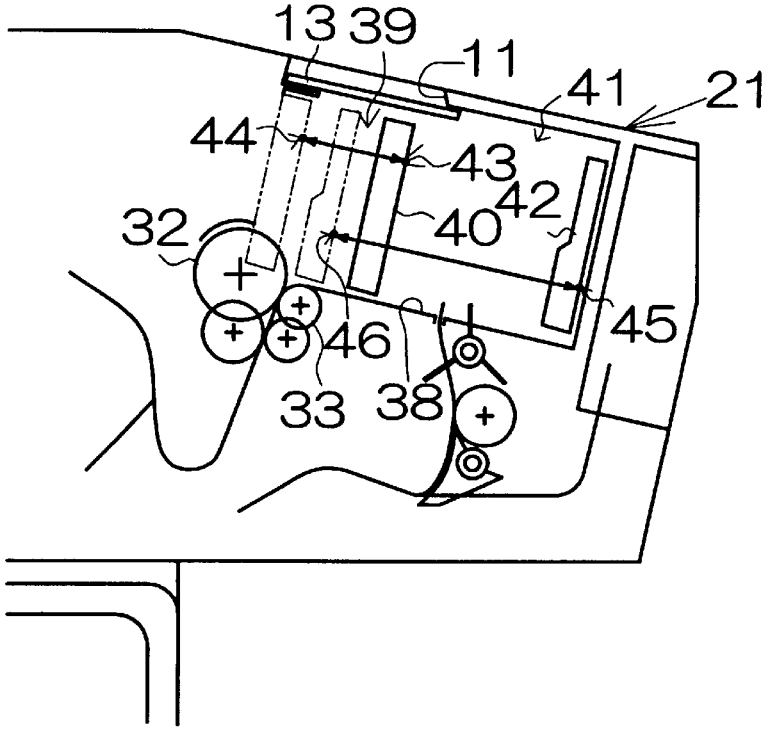
FIG. 4 is an enlarged partial side view of the ATM for schematically illustrating the structure of the leaf transfer mechanism unit.

As shown in FIG. 4, the leaf transfer mechanism unit 21 comprises a slide plane 38 defined by a rigid plate or rigid frames. The slide plane 38 is designed to guide a forward sliding movement of the bills PP toward the pickup rollers 32. The slide plane 38 is tilted up in the forward direction. A partition unit 40 is disposed on or above the slide plane 38. The partition unit 40 is design ed to define a leaf reception room 39 between the pickup rollers 32 and itself. Likewise, a retrieval or rear urging member 42 is disposed on or above the slide plane 38. The retrieval urging member 42 may be a rigid plate or frame. The retrieval urging member 42 is designed to define a leaf delivery room 41 between the partition unit or member 40 and itself behind the partition unit 40. The partition unit 40 and the retrieval urging member 42 are maintained in an attitude upright to the slide plane 38. In addition, the partition unit 40 is allowed to move forward and backward along a predetermined path between a rearmost or standard position 43 remotest from the pickup rollers 32 and a front or turnout position 44 where the pickup rollers 32 is exposed in the leaf delivery room 41 behind the partition unit 40. The retrieval urging member 42 is allowed to move forward and backward along a predetermined path between a rear limit position 45 remotest from the partition unit 40 and a front limit position 46 where the retrieval urging member 42 collides against the pickup rollers 32.

Figure 5:
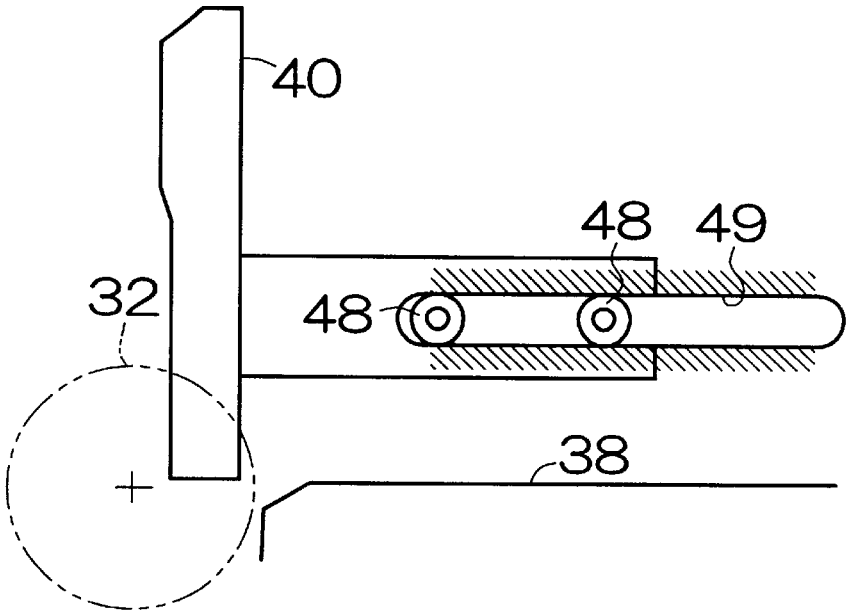
FIG. 5 is a side view of the leaf transfer mechanism unit for schematically illustrating a guide mechanism for movement of a partition unit.
Figure 6:
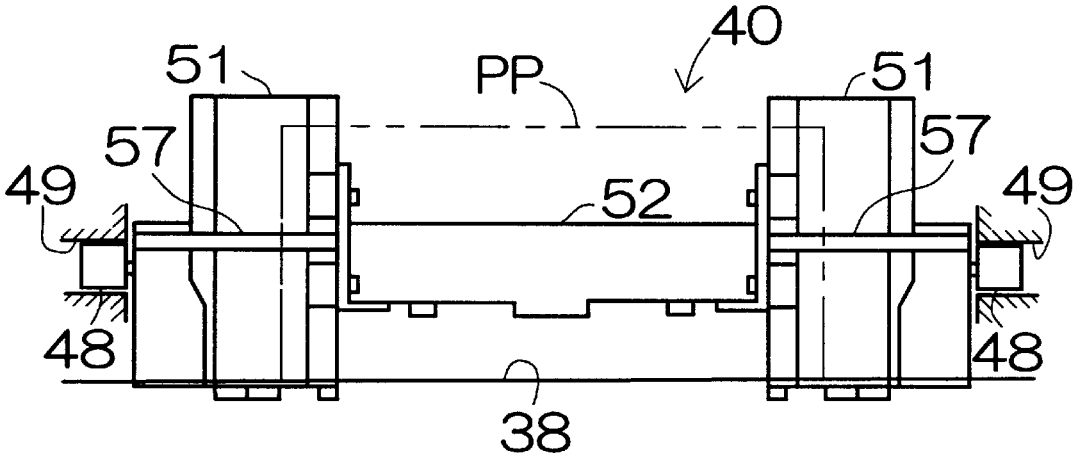
FIG. 6 is a front view schematically illustrating the structure of the partition unit.

As shown in FIG. 5, a guide frame 49 is disposed to extend in the forward and backward direction in parallel with the slide plane 38. The guide frame 49 serves to establish the predetermined path for the sliding movement of the partition unit 40 in combination with a pair of front and rear rollers 48 supported on the partition unit 40 for rotation. The rollers 48 are received and guided in the guide frame 49. The rollers 48 and the guide frame 49 may be arranged on left and right sides of the partition unit 40 in the lateral direction, as shown in FIG. 6. The combination of the rollers 48 and the guide frame 49 serves to allow the partition unit 40 to move forward and backward along the predetermined path keeping the attitude upright to the slide plane 38.

Figure 7:
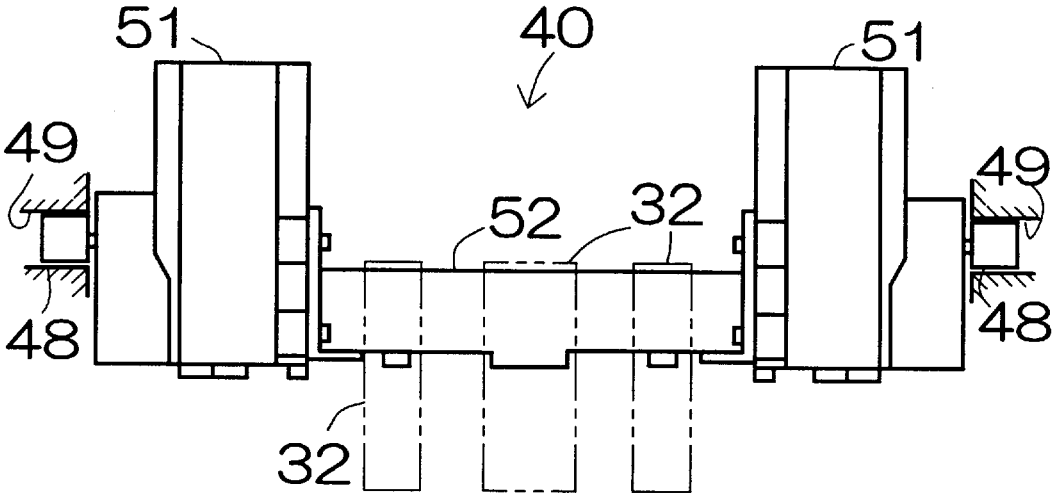
FIG. 7 is a front view of the partition unit for illustrating a reception urging member at a lower limit position.

As shown in FIG. 6, the partition unit 40 includes a pair of upright frames 51 standing upright at left and right sides of the bills PP on or above the slide plane 38. A front or reception urging member 52 is disposed between the upright frames 51. The reception urging member 52 is maintained in an attitude upright to the slide plane 38 in the same manner as the partition unit 40 and the retrieval urging member 42. Moreover, the reception urging member 52 is designed to move between a lower limit position closest to the slide plane 38 and an upper limit position remotest from the slide plane 38. As is apparent from FIG. 7, when the reception urging member 52 is positioned at the lower limit position, the reception urging member 52 is allowed to be opposed to the pickup rollers 32 protruding out of the slide plane 38.

Figure 8:
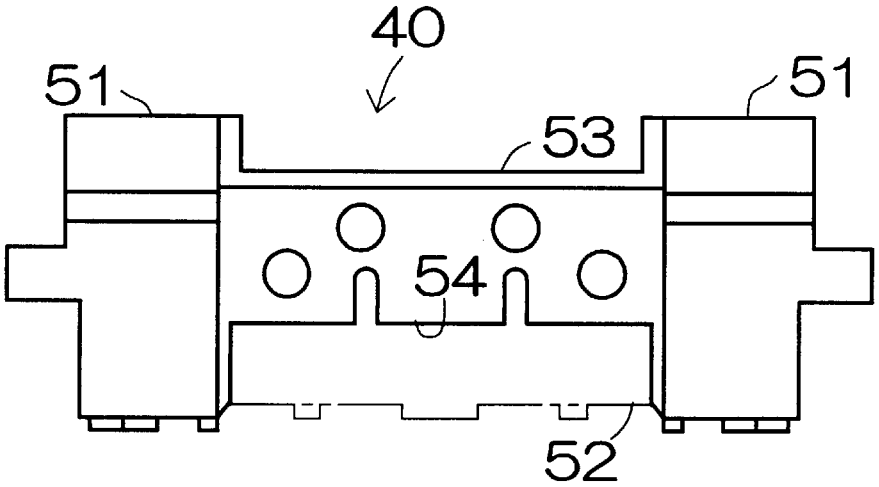
FIG. 8 is a front view of the partition unit for schematically illustrating an intermediate plate.

An intermediate member or plate 53 is employed to rigidly connect the upright frames 51 to each other, as shown in FIG. 8, for example. A recess 54 is defined in the intermediate plate 53 for allowing the pickup rollers 32 protruding out of the slide plane 38 to pass through when the partition unit 40 is caused to move forward to the turnout position 44 (see FIG. 4). The recess 54 serves to avoid collision between the pickup rollers 32 and the intermediate plate 53 during the forward and backward movement of the partition unit 40 along the slide plane 38. The recess 54 can be closed with the reception urging member 52 at the lower limit position.

Figure 9:
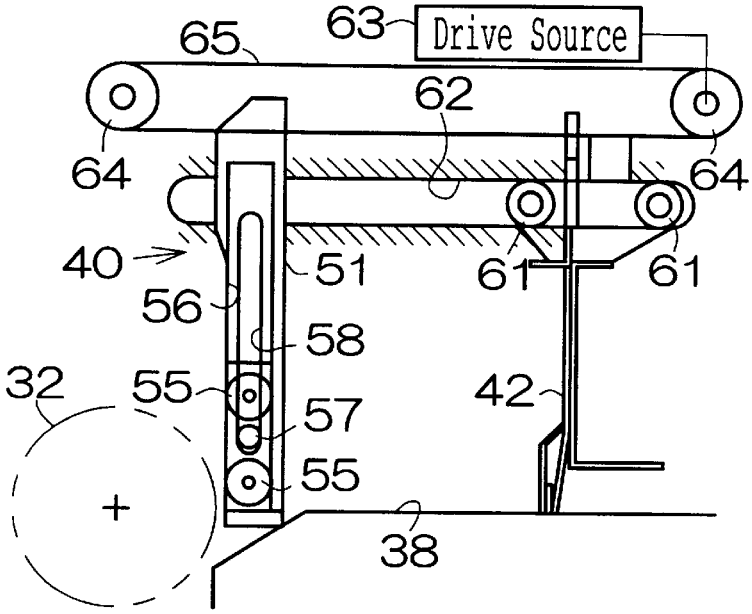
FIG. 9 is a side view of the leaf transfer mechanism unit for illustrating a path for movement of a retrieval urging member.

As shown in FIG. 9, a guide frame 56 is formed in the respective upright frames 52 for defining a guide passage which extends in a direction orthogonal to the slide plane 38. The guide frames 56 are designed to guide the vertical movement of the reception urging member 52 in combination with pairs of upper and lower rollers 55 supported on left and right sides of the reception urging member 52 for rotation.

The reception urging member 52 is provided with a horizontal rod 57 protruding in the horizontal direction from left and right sides of the reception urging member 52, referring to FIGS. 6 and 9. The opposite ends of the horizontal rod 57 are received in slots 58 formed in the upright frames 52, respectively, as is apparent from FIG. 9. The slots 58 are designed to define the upper and lower limit positions of the reception urging member 52 in combination with the horizontal rod 57.

As shown in FIG. 9, a guide frame 62 is also disposed to extend in the forward and backward direction in parallel with the slide plane 38. The guide frame 62 serves to establish a path of movement for the retrieval urging member 42 in combination with a pair of front and rear rollers 61 supported on the retrieval urging member 42 for rotation. The rollers 61 are received and guided in the guide frame 62. The rollers 61 and the guide frame 62 may be arranged on left and right sides of the retrieval urging member 42 in the lateral direction. The combination of the rollers 61 and the guide frame 62 serves to allow the retrieval urging member 42 to move forward and backward along the slide plane 38 keeping the attitude upright to the slide plane 38.

A drive source 63 is designed to control the forward and backward movement of the retrieval urging member 42. The drive source 63 may comprise a servo motor responsive to pulse signals, for example. The driving force from the drive source 63 is transmitted to the retrieval urging member 42 through a transmission belt 65 wound around a pair of front and rear pulleys 64, for example.

Figure 10:
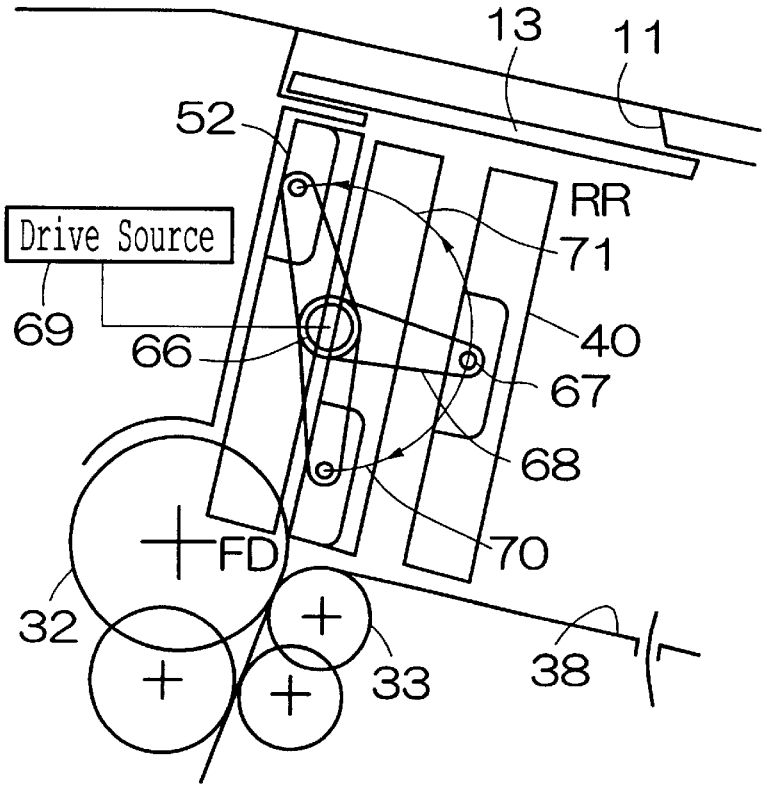
FIG. 10 is a side view of the leaf transfer mechanism unit for illustrating a first and a second advancement path for the reception urging member.

As shown in FIG. 10, a driving piece 67 is rotatively coupled to the reception urging member 52. The driving piece 67 is designed to move along a circular orbit described around a rotation axis 66 in parallel with the rotational axis of the pickup rollers 32. The driving piece 67 may be formed as the tip end of a lever 68 designed to swing around a support axis 66, for example. The horizontal rod 57 may receive the respective driving piece 67 at the opposite ends protruding from the left and right sides of the reception urging member 52 in the aforementioned manner. When the driving piece 67 moves in response to the swinging movement of the lever 68, the reception urging member 52 is allowed to move in the vertical direction while being guided by the partition unit 40. The vertical movement of the reception urging member 52 in this manner induces the forward and backward movement of the partition unit 40. A drive source 69 is connected to the support axis 66 for controlling the swinging movement of the lever 68. The drive source 69 may comprise a servo motor responsive to pulse signals, for example.

For example, when the partition unit 40 is positioned at the standard position 43, the reception urging member 52 is located at a rearmost position RR remotest from the pickup rollers 32. If the driving piece 67 moves from the rearmost position RR in the normal direction, namely, the clockwise direction in FIG. 10, so as to turn around the support axis 66, the reception urging member 52 is allowed to trace a first advancement path 70. The first advancement path 70 is designed to extend toward the pickup rollers 32 from the rearmost position RR so as to reach a front or collision position FD allowing the reception urging member 52 to collide against the pickup rollers 32. On the other hand, if the driving piece 67 moves from the rearmost position RR in the reverse direction, namely, the counterclockwise direction in FIG. 10, so as to turn around the support axis 66, the reception urging member 52 is allowed to trace a second advancement path 71. The second advancement path 71 is designed to extend from the rearmost position RR so as to make a roundabout of the pickup rollers 32. The second advancement path 71 of the reception urging member 52 serves to avoid collision between the pickup rollers 32 and the reception urging member 52 during the advance movement of the partition unit 40 reaching the turnout position 44. In this manner, determination of the direction for rotation of the driving piece 67 serves to allow the reception urging member 52 to selectively trace either of the first and second advancement paths 70, 71.

Figure 11:
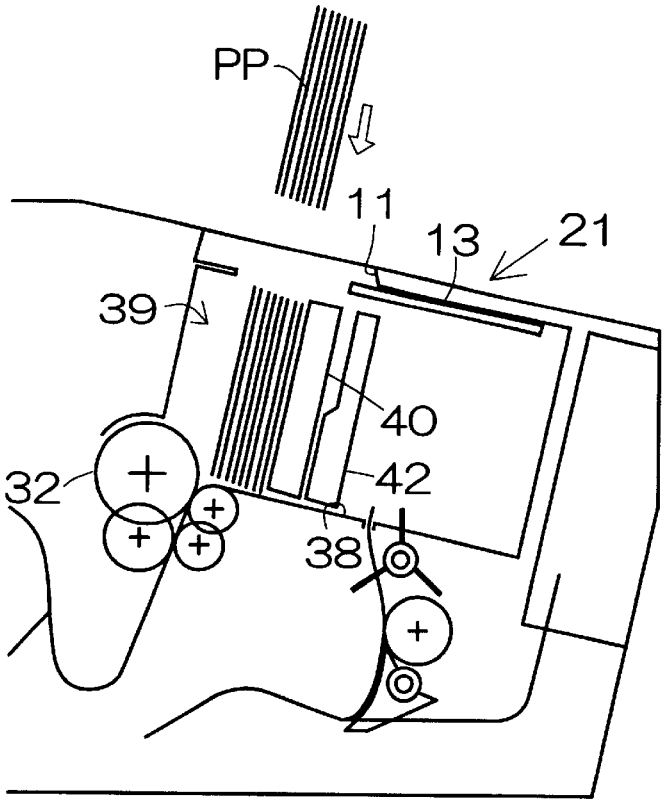
FIG. 11 is a side view illustrating the operation of the leaf transfer mechanism unit when bills are input.

Next, description will be made on the operation of the aforementioned leaf transfer mechanism unit 21. Assume that a stack of bills PP are thrown into the leaf input opening 11, for example. As shown in FIG. 11, the partition unit 40 has been positioned at the standard position 43 prior to insertion of the bills PP. Accordingly, the leaf reception room 39 is defined between the pickup rollers 32 and the partition unit 40 for receiving the bills PP through the leaf input opening 11. When the cover 13 is opened, a customer is allowed to insert the bills PP, in an upright attitude, into the leaf reception room 39. The slide plane 38 receives the lower ends or edges of the bills PP. The retrieval urging member 42 is expected to stand by right behind the partition unit 40. The reception urging member 52 incorporated within the partition unit 40 is positioned at the rearmost position RR remotest from the pickup rollers 32 (see FIG. 10, for example).

Figure 12:
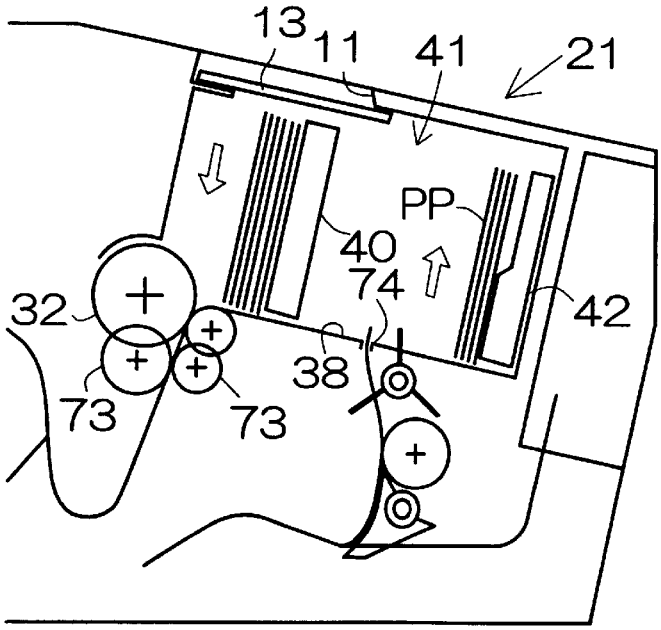
FIG. 12 is a side view illustrating the operation of the leaf transfer mechanism unit when bills are transferred.

When the cover 13 is then closed, the drive source 69 drives the lever 68 for swinging movement around the support axis 66 in the normal direction. The partition unit 40 is consequently allowed to move forward as shown in FIG. 12. The reception urging member 52 is caused to move forward toward the pickup rollers 32 along the first advancement path 70. The reception urging member 52 is expected to urge the bills PP against the pickup rollers 32. The rotating pickup rollers 32 serve to transfer the bills PP, one by one, to the subsequent rollers 73. The subsequent rollers 73 are designed to hand the received bills PP over the discrimination section 22.

Prior to the initial operation of the pickup rollers 32, the drive source 63 drives the retrieval urging member 42 for backward movement until the retrieval urging member 42 reaches the rear limit position 45, as shown in FIG. 12. The leaf delivery room 41 is defined behind the partition unit 40 between the retrieval urging member 40 and the partition unit 40. The leaf transfer mechanism unit 21 is thus prepared to receive bills PP, determined unacceptable at the discrimination section 22 in the aforementioned manner. The bills PP to be returned from the discrimination section 22 to the leaf transfer mechanism unit 21 are sequentially discharged into the leaf delivery room 41 through a discharge slot 74 defined in the slide plane 38.

Assume that all of the bills PP have been taken out of the leaf reception room 39. If a bill PP is detected in the leaf delivery room 41, the drive source 69 is designed to drive the lever 68 for swinging movement in the reverse direction around the support axis 66. The partition unit 40 is thus allowed to once return backward to the standard position 43 and then move forward to the turnout position 44. During the advancement of the partition unit 40, the reception urging member 52 is allowed to trace the second advancement path 71 (see FIG. 10, for example). The reception urging member 52 is lifted up so as to open the recess 54 in the partition unit 40. The partition unit 40 and the reception urging member 52 are thus reliably prevented from collision against the pickup rollers 32 during the advancement of the partition unit 40 along with the incorporated reception urging member 52 to the turnout position 44.

Figure 13:
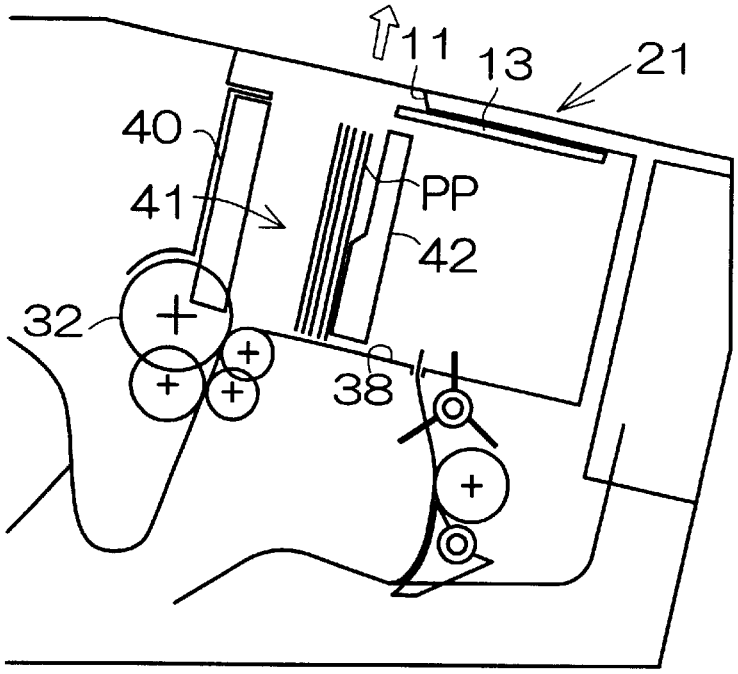
FIG. 13 is a side view illustrating the operation of the leaf transfer mechanism unit when bills are dispensed.

As shown in FIG. 13, when the partition unit 40 has reached the turnout position 44, at the same time, the drive source 63 is designed to allow the retrieval urging member 42 to advance to the position corresponding to the standard position 43 of the partition unit 40. The bills PP in the leaf delivery room 41 are urged to move forward along the slide plane 38, keeping the upright attitude. When the cover 13 is opened, the customer is allowed to pick up the bills PP, including other types of leaves, returned to the leaf delivery room 41 through the leaf input opening 11.

Figure 14:
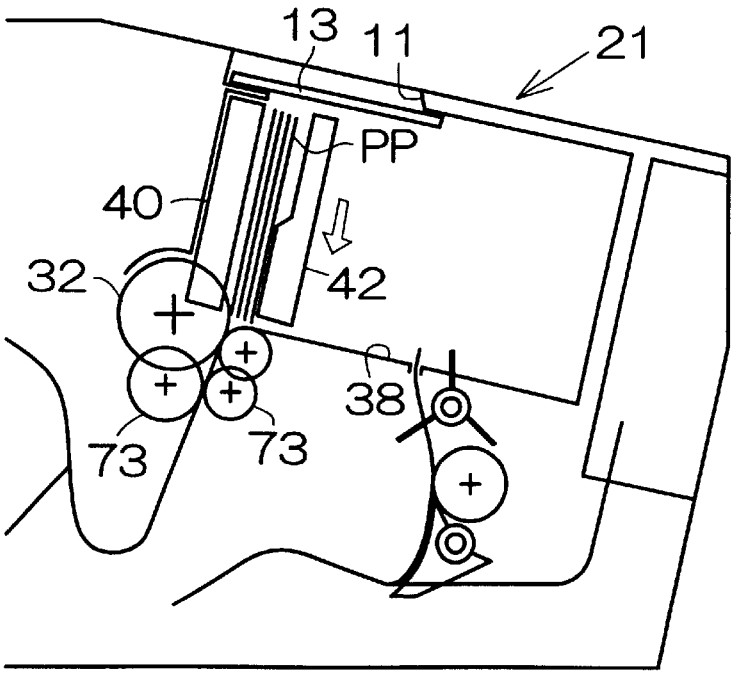
FIG. 14 is a side view illustrating the operation of the leaf transfer mechanism unit when the left bills are transferred.

Assume that the customer carelessly leaves the returned bills PP in the leaf delivery room 41. The drive source 63 is then designed to allow the retrieval urging member 42 to further move forward toward the pickup rollers 32, as shown in FIG. 14. The retrieval urging member 42 is thus caused to urge the bills PP against the pickup rollers 32. The rotating pickup roller 32 serve to sequentially transfer the bills PP, one by one, to the subsequent rollers 73. Since the partition unit 40 is allowed to reach the turnout position 44 beyond the front limit position 46 of the retrieval urging member 42, the pickup rollers 32 are reliably exposed behind the partition unit 40. The bills PP left in the leaf delivery room 41 can reliably be urged against the pickup rollers 32 by the retrieval urging member 42 behind the partition unit 40.

When cash is to be dispensed, the retrieval urging member 42 is moved backward to the rear limit position 45, while the partition unit 40 is kept at the standard position 43. The leaf delivery room 41 is thus prepared between the partition unit 40 and the retrieval urging member 42 so as to receive bills sequentially discharged from the discharge slot 74. When a set of bills corresponding to the requested amount of money are prepared in the leaf delivery room 41, the partition unit 40 is caused to move forward to the turnout position 44 while the retrieval urging member 42 is allowed to move forward to the position corresponding to the standard position 43 of the partition unit 40 in the same manner as described above. When the cover 13 is opened, a customer is allowed to pick up the bills out of the leaf delivery room 41. If any bill is left in the leaf delivery room 41, the retrieval urging member 42 is allowed to move forward to urge the left bill against the pickup rollers 32 in the same manner as described above. The urged bill can finally be transferred to the subsequent rollers 73.

What is claimed is:

1. A leaf transfer mechanism unit comprising:

a pickup roller;

a retrieval urging member moveable forward toward the pickup roller along a predeterminied path leading to a front limit position allowing the retrieval urging member to collide against the pickup roller; and a partition member moveable forward in front of the retrieval urging member along the predeterimined path beyond the front limit position for the retrieval urging member so as to reach a turnout position.

2. The leaf transfer mechanism unit according, to claim 1, further comprising a reception urging member interlocked with the partition member and moveable forward toward the pickup roller within the limit of a collision position allowing the reception urging member to collide against the pickup roller.

3. The leaf transfer mechanism unit according to claim 2, further comprising:

a guide passage formed in the partition member for guiding movement of the reception urging member; and a driving piece connected to tie reception urging member and moveable along a circular orbit described around a rotation axis in parallel with a rotational axis of the pickup roller.

4. The leaf transfer mechanism unit according to claim 1, further comprising:

a reception urging member disposed between the pickup roller and the retrieval urging member at a rearmost position remotest from the pickup roller; and a guide passage formed in the partition member for guiding movement of the reception urging member, wherein the reception urging member selectively traces a first and a second advancement path, the first advancement path extending toward the pickup roller from the rearmost position so as to reach a collision position allowing the reception urging member to collide against the pickup roller, the second advancement path extending from the rearmost position so as to make a roundabout of the pickup roller.

5. The leaf transfer mechanism unit according to claim 4, wherein a driving piece is connected to the partition member so as to move along a circular orbit described around a rotation axis in parallel with a rotational axis of the pickup roller.

6. A leaf transfer mechanism unit comprising:

a pickup roller;

a real urging member moveable forward toward the pickup roller within the limit of a front limit position allowing the rear urging member to collide against the pickup roller;

a front urging member disposed between the pickup roller and the rear urging member at a rearmost position remotest from the pickup roller; and a driving mechanism connected to the front urging member so as to guide the first urging member selectively along a first and a second advancement path, the first advancement path extending toward the pickup roller from the rearmost position so as to reach a collision position allowing the front urging member to collide against the pickup roller, the second advancement path extending, from the rearmost position so as to make a roundabout of the pickup roller.

7. The leaf transfer mechanism unit according, to claim 6, wherein said driving mechanism includes a driving piece connected to the front urging member so as to move alone a circular orbit described around a rotation axis parallel to a rotational axis of the pickup roller.

8. A leaf management apparatus comprising:

a pickup roller;

a partition member moveable toward the pickup roller, a leaf reception room defined between the pickup roller and the partition member;

a retrieval urging member moveable forward toward the pickup roller within the limit of a front limit position allowing the retrieval urging member to collide against the pickup roller; and a leaf delivery room defined behind the partition member between the partition member and the retrieval urging member, wherein the partition member may reach a turnout position where the pickup roller is exposed in the leaf delivery room behind the partition member.

9. A leaf management apparatus comprising:

a pickup roller;

a rear urging member moveable forward toward the pickup roller within the limit of a front limit position allowing the rear urging member to collide against the pickup roller;

a front urging member disposed between the pickup roller and the rear member at a rearmost position remotest from the pickup roller; and a driving mechanism connected to the front urging member so as to guide the first urging member selectively along a first and a second advancement path, the first advancement path extending toward the pickup roller from the rearmost position so as to reach a collision position allowing the front urging member to collide against the pickup roller, the second advancement path extending from the rearmost position so as to make a roundabout of the pickup roller.

10. The leaf management apparatus according to claim 9, wherein said mechanism includes a driving piece connected to the front urging member so as to move along a circular orbit described around a rotation axis parallel to a rotational axis of the pickup roller.

* * * * *